US011408086B2

(12) United States Patent
LaVallee

(10) Patent No.: US 11,408,086 B2
(45) Date of Patent: Aug. 9, 2022

(54) METHOD FOR CREATING MULTIPLE ELECTRICAL CURRENT PATHWAYS ON A WORK PIECE

(71) Applicant: Lacks Enterprises, Inc., Grand Rapids, MI (US)

(72) Inventor: Michael LaVallee, Grand Rapids, MI (US)

(73) Assignee: Lacks Enterprises, Inc., Grand Rapids, MI (US)

( * ) Notice: Subject to any disclaimer, the term of this patent is extended or adjusted under 35 U.S.C. 154(b) by 128 days.

(21) Appl. No.: 14/712,702

(22) Filed: May 14, 2015

(65) Prior Publication Data

US 2016/0333491 A1 Nov. 17, 2016

(51) Int. Cl.

| | |
|---|---|
| ***C25D 5/02*** | (2006.01) |
| ***C25D 5/56*** | (2006.01) |
| ***C25D 13/02*** | (2006.01) |
| ***C25D 13/20*** | (2006.01) |
| ***C25D 13/22*** | (2006.01) |
| ***C23C 18/16*** | (2006.01) |
| ***C25D 13/12*** | (2006.01) |

(52) U.S. Cl.

CPC ..... *C25D 5/022* (2013.01); *C23C 18/1605* (2013.01); *C23C 18/1653* (2013.01); *C25D 5/02* (2013.01); *C25D 5/56* (2013.01); *C25D 13/02* (2013.01); *C25D 13/12* (2013.01); *C25D 13/20* (2013.01); *C25D 13/22* (2013.01)

(58) Field of Classification Search

CPC . C25D 5/02; C25D 5/022; C25D 5/54; C25D 5/56; C25D 13/12; C25D 13/20; C25D 13/02; C25D 13/22; C25D 11/022; C23C 18/1653; C23C 18/1605

See application file for complete search history.

(56) References Cited

U.S. PATENT DOCUMENTS

| | | | | | |
|---|---|---|---|---|---|
| 4,445,979 | A * | 5/1984 | Lutfy | C25D 5/02 | 205/101 |
| 4,999,094 | A * | 3/1991 | Kamamori | C25D 13/00 | 204/484 |
| 5,441,626 | A * | 8/1995 | Ogisu | B60R 19/52 | 205/118 |
| 5,484,516 | A * | 1/1996 | Funahashi | B60R 19/52 | 205/118 |
| 5,630,928 | A * | 5/1997 | Ogisu | B05D 1/322 | 205/118 |
| 2002/0197492 | A1* | 12/2002 | Hao | C25D 5/022 | 428/457 |
| 2004/0007471 | A1* | 1/2004 | Phu | C25D 5/56 | 205/122 |

(Continued)

FOREIGN PATENT DOCUMENTS

JP 59126790 A * 7/1984

*Primary Examiner* — Louis J Rufo

(74) *Attorney, Agent, or Firm* — Dickinson Wright PLLC

(57) ABSTRACT

A method for plating a work piece. An electroless layer of material is applied to the work piece using an electroless plating process. The method includes creating a barrier in electrical conductivity in the work piece to divide the work piece into a first segment and a second segment which are substantially electrically insulated from one another, prior to electroplating the work piece. A plurality of methods are disclosed for dividing the work piece into the first and second segments.

24 Claims, 4 Drawing Sheets

(56) References Cited

U.S. PATENT DOCUMENTS

| | | | | |
|---|---|---|---|---|
| 2006/0042932 | A1* | 3/2006 | Rosenzweig | C25D 17/12<br>204/230.2 |
| 2006/0222824 | A1* | 10/2006 | Yasuhara | H01H 13/14<br>428/195.1 |
| 2012/0164398 | A1* | 6/2012 | Reeder | C23C 18/24<br>428/195.1 |
| 2014/0054176 | A1* | 2/2014 | Stoimenov | C25D 17/00<br>205/118 |

* cited by examiner

METHOD FOR CREATING MULTIPLE ELECTRICAL CURRENT PATHWAYS ON A WORK PIECE

TECHNICAL FIELD

The present disclosure relates generally to improved aesthetics for work pieces, including by a method of electroplating. More specifically, the present disclosure relates to a method for creating multiple electrical current pathways on a work piece to allow for the presence of multiple separate finishes on a single plastic work piece.

BACKGROUND OF THE DISCLOSURE

Plated decorative chrome finishes have long been available for various products in the automotive, appliance, consumer electronics, and household application industries. Variations in the deposition methods, processing conditions, and solution makeup of the various types of metals have subsequently resulted in aesthetic variations in the final product. These variations in processing, chemical, and deposition techniques are able to generate different color metal finishes, lower gloss levels, and less distinction of image (DOI) in the metal finish of work pieces all with an eye to improving aesthetics. Examples of these finishes include but are not limited to Bright Chrome, Black Nickel, Black Chrome, and the like. Another exemplary finish that has been employed is Satin Chrome, which involves varying the reflectivity of the underlying metal layer such as by creating more pits in the substrate surface. Varying the degree of reflectivity allows for many different types of metal finishes. Often, these variations are combined with a bright chromium finish in assemblies to 1) complement each other and 2) bring more aesthetic appeal to the final product.

A known method of finishing work pieces to provide a final product that has multiple distinct surface finishes includes utilizing work piece assemblies that are made up of multiple components, each having a different metal finish and which are assembled to form the final product. This practice, while effective, results in multiple operations and multiple sets of tooling which adds significant cost to the final product.

Another known method of finishing work pieces to provide a final product that has multiple distinct surface finishes includes applying bright and satin-like finishing to the surface of the work piece with masking and pre or post surface treatments using abrasive grains such as iron powder, glass powder, silicon oxide, alumina and the like. Molded in texture or surface effects have also been employed to create variation in the metal finish of the work piece by selectively incorporating the texture or surface finish into a portion of the work piece prior to application of a metal finish. However, when such work pieces, which include one section employing these surface effects and another part without these effects, are both subjected to electroplating, the leveling characteristic of the electroplated layer on these two sections does not create the visual effect of two distinct metal surface finishes as desired. Also, the pre and post surface treatments are costly and require an additional operation.

Vacuum metallization and chemical vapor deposition techniques are able to achieve a final product that has segments with different finishes, but are very costly and limited from a performance standpoint in many environments because of the thin layer of metal that results from these techniques. Additionally, physical vapor deposition coatings must include an organic coating thereover to protect the deposited metal layer. This additional step increases labor costs and creates an "orange peel" look due to the fact that the organic coating is not completely smooth.

Another method of creating two distinct surface effects on a work piece includes masking and painting using tinted basecoats and clear coats. Although this method creates the desired effect, it disadvantageously requires an additional painting operation which adds cost to the final product.

In view of the above, there remains a need for improved methods of treating work pieces that provide for a final product that includes more than one surface finish on a single work piece. More specifically, there remains a need for a method which offers more degrees of flexibility to designers and manufacturers with regards to its aesthetic effects while reducing the overall part and manufacturing costs by eliminating secondary operations.

SUMMARY OF THE DISCLOSURE

A method for plating a plastic work piece using a power source having a positive terminal and a negative terminal is provided. The method includes applying an electroless layer of material to the work piece using an electroless plating process. The positive terminal of the power source may be connected to a first anode and the negative terminal of the power source may be connected to the work piece. The work piece can then be immersed in a first aqueous solution that contains the first anode. The first anode may then be positively charged and the work piece may be negatively charged to cause metal ions in the first aqueous solution to be passed onto the electroless layer of the work piece.

The method can further include creating at least one barrier in electrical conductivity in the work piece prior to the step of immersing the work piece in a first aqueous solution to divide the work piece into at least a first segment and a second segment which are substantially electrically insulated from one another.

The negative terminal of the power source can also be connected to the second segment of the work piece. The method may also include immersing the work piece in a second aqueous solution that contains a second anode. Once the work piece is immersed in the second aqueous solution, the second anode can be positively charged and a second negative charge may be applied to the second segment of the work piece to cause metal ions from the second aqueous solution to be passed onto the electroless layer of only the second section of the work piece to form a second electroplated layer on the second segment of the work piece.

It is therefore an aspect of the present disclosure to provide a method for plating a work piece with multiple surface finishes. The method eliminates the need for costly secondary operations to finish the work piece since creating the barrier in electrical conductivity and respectively electroplating the first and second segments of the work piece may be done in an inexpensive and simple process.

BRIEF DESCRIPTION OF THE DRAWINGS

Other aspects of the present disclosure will be readily appreciated, as the same becomes better understood by reference to the following detailed description when considered in connection with the accompanying drawings wherein.

DESCRIPTION OF THE PREFERRED EMBODIMENTS

Figure 1:
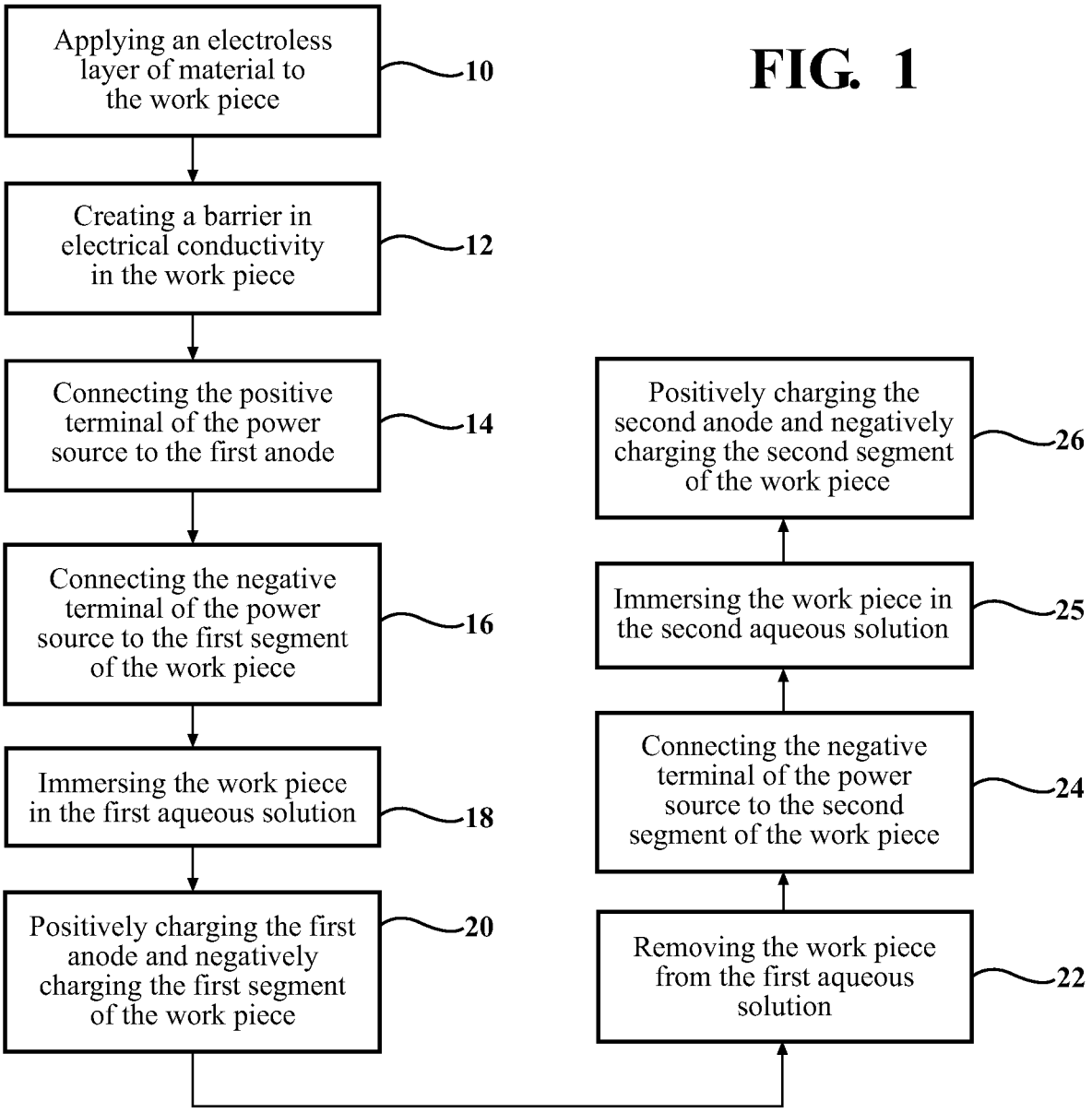
FIG. 1 is flow diagram of a method of plating a work piece in accordance with an aspect of the disclosure.

Referring to the Figures, wherein like numerals indicate corresponding parts throughout the several views, a method is generally shown for plating a work piece 100 using a power source 102 (e.g., a battery) having a positive terminal 104 and a negative terminal 106. It will be appreciated that a variety of suitable power sources may be employed.

According to an aspect, as exemplarily shown in FIGS. 1-4, the method includes creating a barrier 114 to electrical conductivity in a base substrate layer 110 of the work piece 100. Thereafter, an electroless layer of material 108 can be applied to the base substrate layer 110 of the work piece 100 using an electroless plating process, as generally indicated by reference number 10. As known in the art, the electroless plating process generally includes an autocatalytic chemical reaction which causes a metal to be deposited on the base substrate layer 110 of the work piece 100 such that the substrate layer 110 will be conductive. According to an aspect, the electroless layer of material 108 can act as a base layer that has good adherence to both the substrate layer 110 of the work piece 100 as well as to a subsequently plated electroplated layer 124, 132, as described illustratively below. Therefore, once the electroless layer of material 108 is adhered to the base substrate layer 110 of the work piece 100, the work piece 100 may be well-suited for receiving subsequent electroplated layers thereon. It should be appreciated that suitable metals for plating (both electroless plating and electroplating) according to the subject method may include, but are not limited to, copper, nickel, zinc, palladium, gold, cobalt, chromium (i.e., chrome), and alloys thereof. Furthermore, the material of the substrate layer 110 of the work piece 100 in accordance with an aspect may be plastic, but other suitable materials for both the metal layers and the substrate could be used without departing from the scope of the subject disclosure. According to another aspect, a non-conductive base substrate layer 110, such as a non-conductive plastic, may be rendered conductive in a variety of other suitable ways. For example, the work piece 100 may include or be formed of a conductive plastic. According to a further aspect, a conductive paint may be applied over the base substrate layer 110 such that the part is suitable for receiving subsequent electroplated layers thereon.

Figure 2:
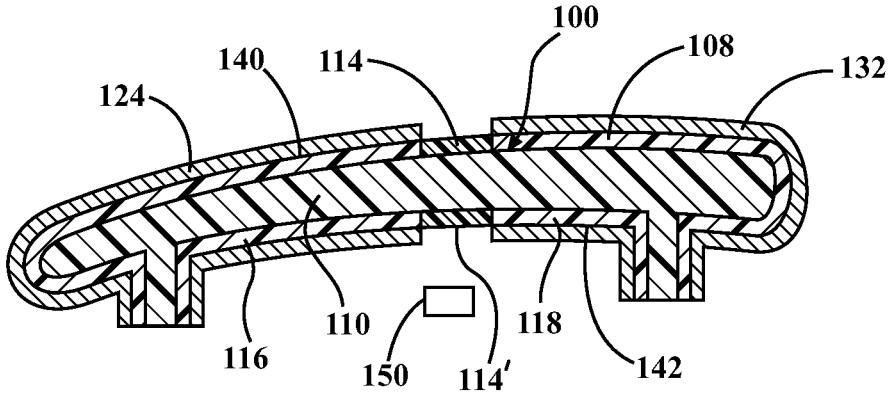
FIG. 2 is a side cross-sectional view of a work piece having a barrier formed thereon in accordance with an aspect of the disclosure.
Figure 3:
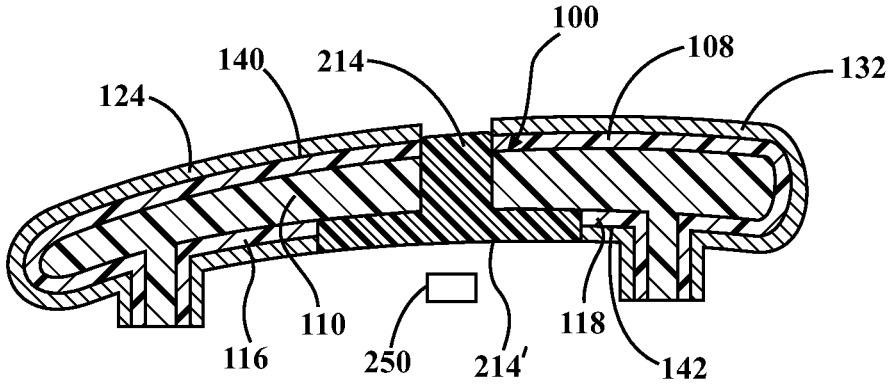
FIG. 3 is a side cross-sectional view of a work piece having a barrier formed thereon in accordance with another aspect of the disclosure.
Figure 4:
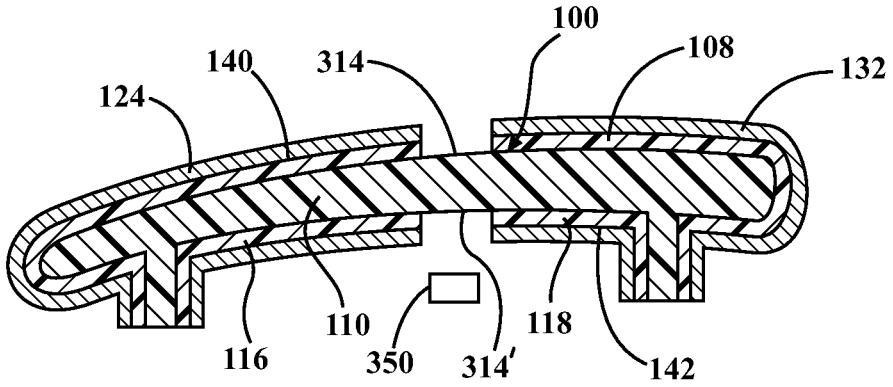
FIG. 4 is a side cross-sectional view of a work piece having a barrier formed thereon in accordance with a further aspect of the disclosure.

According to an aspect, the method can also include creating a barrier 114, 214, 314 in electrical conductivity in the work piece 100 to divide the work piece 100 into a first segment 116 and a second segment 118, with the first and second segments 116, 118 substantially electrically insulated from one another, as generally indicated by reference number 12. As a result, a current may flow through each respective first and second segment 116, 118 without flowing through the other. As shown in FIGS. 2-4, first and second segment 116, 118 have a non-planar curvature.

According to an aspect and as exemplarily shown in FIG. 2, a barrier 114 in electrical conductivity in the work piece 100 may be created, formed or disposed on the base substrate layer 110 prior to application of the electroless layer of material 108 to the work piece 100. According to an aspect, the step of creating a barrier 114 in the work piece 100 may include applying a plating resistant coating on the work piece to define the barrier 114 so as to substantially prevent the subsequent deposition of the electroless layer of material 108 on the barrier 114. The plating resist coating 114 may include a non-plateable plastic resin that may be applied to the surface. The plating resist coating may be a polyvinyl chloride material, a polycarbonate material or the like that is applied to the substrate, such as by painting. It will be appreciated that this material should substantially prevent the electroless layer of material 108 from being formed on areas of the base substrate layer 110 that are insulated from the area to which current is applied. It will also be appreciated that a variety of other suitable materials which resist plating may be employed. Such a material may vary depending on what kind of metal is being applied thereon by way of the electroless plating process. It should be appreciated that since the area of the barrier 114 is unable to receive the electroless layer of material 108, after the electroless layer of material 108 is applied on the remaining portions of the work piece 100, the first and second segments 116, 118 of the work piece 100 may each be configured as respective electrical circuits that are isolated from the other. As shown in FIG. 2, according to an aspect, the barrier 114 may be formed on both a front surface 140 and a back surface 142 of the work piece 100 to ensure that they are electrically isolated from one another so long as current between the sections is isolated. While the barrier 114' is illustrated as disposed opposite the barrier 114, it will be appreciated that they can be offset.

According to another aspect as exemplarily shown in FIG. 3, a barrier 214 in electrical conductivity in the work piece 100 may be created, formed or disposed on the base substrate layer 110 prior to application of an electroless layer of material 108 to the work piece 100. According to a further aspect, the step of creating a barrier 214 in the work piece 100 may include molding a non-plateable material 214 into or onto the work piece 100 to define the barrier 214 so as to substantially prevent the deposition of the electroless layer of material 108 on the barrier 214. Like the plating resistant coating 114, the non-plateable material 214 may include a non-plateable plastic resin including, but not limited to, a polyvinyl chloride material, a polycarbonate material or the like. Again, this material should substantially prevent the electroless layer of metal from being formed thereon. According to this aspect, the molding process for creating this layer may include a multi-shot injection molding process, a transfer molding process, an over-molding process or the like. It will be appreciated that a variety of other suitable molding processes may be employed. Again, it should be appreciated that since the area of the barrier 214 is unable to receive the electroless layer of material 108, after the electroless layer of material 108 is applied on the remaining portions of the work piece 100, the first and second segments 116, 118 of the work piece 100 may each function as respective electrical circuits that are isolated from one another. As shown in FIG. 3, according to an aspect, the barrier 214 may be formed on both a front surface 140 and a back surface 142 of the work piece 100 to ensure that they are electrically isolated from one another. While the barrier 214' is illustrated as disposed opposite the barrier 214, it will be appreciated that they can be offset so long as current between the sections is isolated. Additionally, as shown, the barrier 214' may be larger in size and take up more of the back side 142 surface.

According to a further aspect as exemplarily shown in FIG. 4, the step of creating a barrier 314 in electrical conductivity in the work piece 100 can alternately occur after the electroless layer of material 108 has been applied, and may include removing a portion of the electroless layer of material 108 to define the barrier 314 in electrical conductivity. When the electroless layer of material 108 is removed to create the barrier 314 subsequent electroplated layers will not deposit due to the non-conducting surface under the electroless layer, making the first and second segments 114, 116 of the work piece 100 function as respective, isolated, electrical circuits. The barrier segment of the electroless layer of material 108 may be removed by a mechanical mechanism, chemical dissolution or the like. It will be appreciated that a variety of other suitable removing process may be employed. As shown in FIG. 4, according to an aspect, the barrier 314 may be formed on both a front surface 140 and a back surface 142 of the work piece 100 to ensure that they are electrically isolated from one another. While the barrier 314' is illustrated as disposed opposite the barrier 314, it will be appreciated that they can be offset so long as current between the sections isolated.

It should be appreciated that any combination of the aforementioned methods may be used to create the barrier 314 in electrical conductivity. According to an aspect, the barrier 314 on the front surface can be formed utilizing one method and the barrier 314' on the back surface can be formed utilizing another method. For example, the barrier 314 on the front surface can be formed via an injection molding method utilizing a material that is resistant to plating and the barrier 314' on the back surface can be formed utilizing a spray resist coating. It will be appreciated that a variety of other suitable ways may be employed to create barriers to electrical conductivity.

Figure 5:
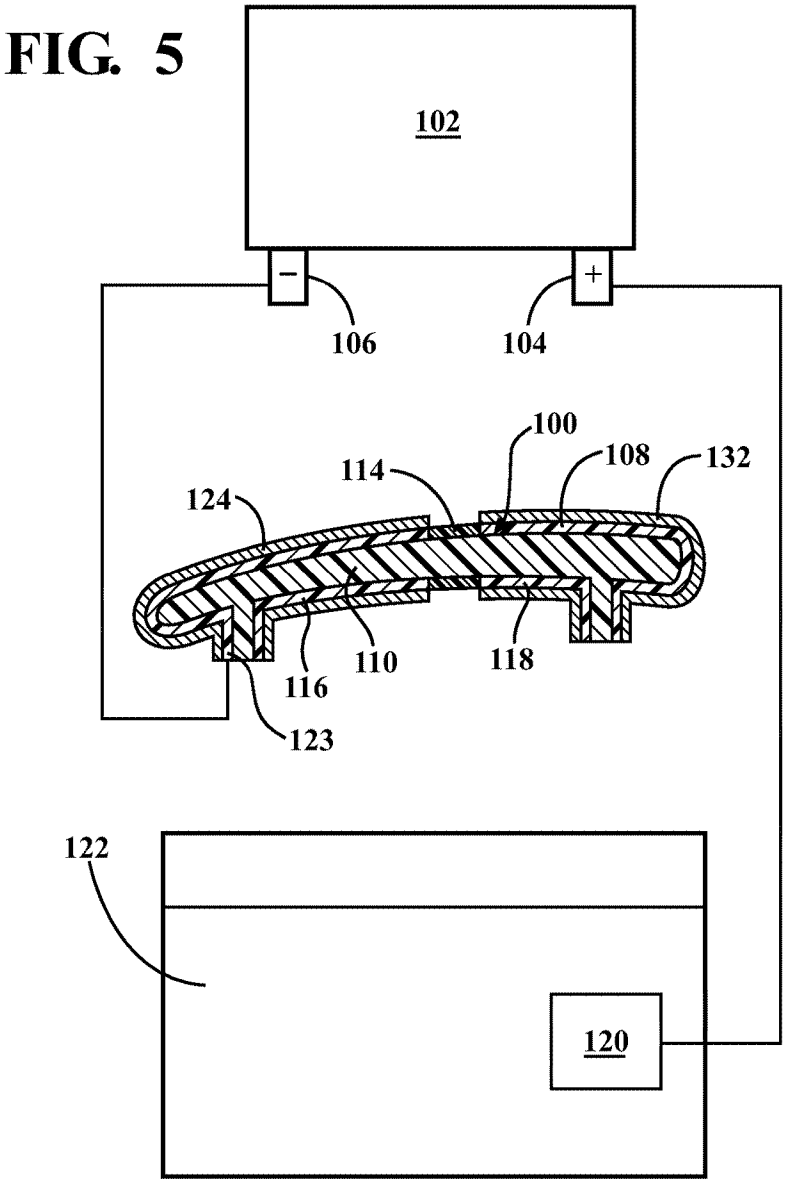
FIG. 5 is a side cross-sectional view of a power source, a first aqueous solution, a first anode and a work piece in accordance with an aspect of the disclosure.

According to an aspect, as shown FIGS. 1 and 5, the method may proceed with the step of connecting the positive terminal 104 of the power source 102 to a first anode 120, as generally indicated by reference number 14. The first anode 120 may be made of a metal material and may be placed in a first aqueous solution 122 with current being applied to the first anode 120. The first anode 120 may be soluble, where the material will dissolve into a first aqueous solution 122 as current is passed through it or insoluble, where the anode material will not dissolve into the solution as current is applied therethrough. It will be appreciated that the first anode 120 could be constructed of a metal material, which may include, but is not limited to, copper, nickel, zinc, palladium, gold, cobalt, chromium (i.e., chrome), and alloys thereof. According to an aspect, the metal material from the first anode 120 may be used directly for plating purposes on the work piece 100. Alternatively, the plating to the work piece 100 can occur from the metal ions available in the first aqueous solution 122, as will be understood by one of ordinary skill in the art. The first anode 120 may be in the form of a solid mass of material that is insoluble or soluble, while the plating solution is composed of a plurality of metal salts necessary to achieve the desired plated layer.

According to aspect, the method proceeds with connecting the negative terminal 106 of the power source 102 to a first point of contact 123 on the first segment 116 of the work piece 100, as generally indicated by reference number 16. The work piece 100 may then be immersed in the first aqueous plating solution 122 which may contain metal salts and the first anode 120, as generally indicated by reference number 20. After the work piece 100 has been immersed in the first aqueous solution 122, the method can proceed with 20 positively charging the first anode 120 and negatively charging the first segment 116 of the work piece 100 to cause the metal ions in the first aqueous solution 122, to be reduced to their metallic state at the solution interface of the first segment 116. A layer of metal may then form on the first segment 116 because it is the only location on the work piece 100 that has a supply of electrons to reduce the metal salts to their respective metal state (i.e., $Cu^{2+}+2e \rightarrow Cu^{0}$). Because there is no supply of electrons on the second segment 118 (since it is electrically isolated), metal ions in the first aqueous solution 122 cannot be reduced to their metallic state.

Figure 6:
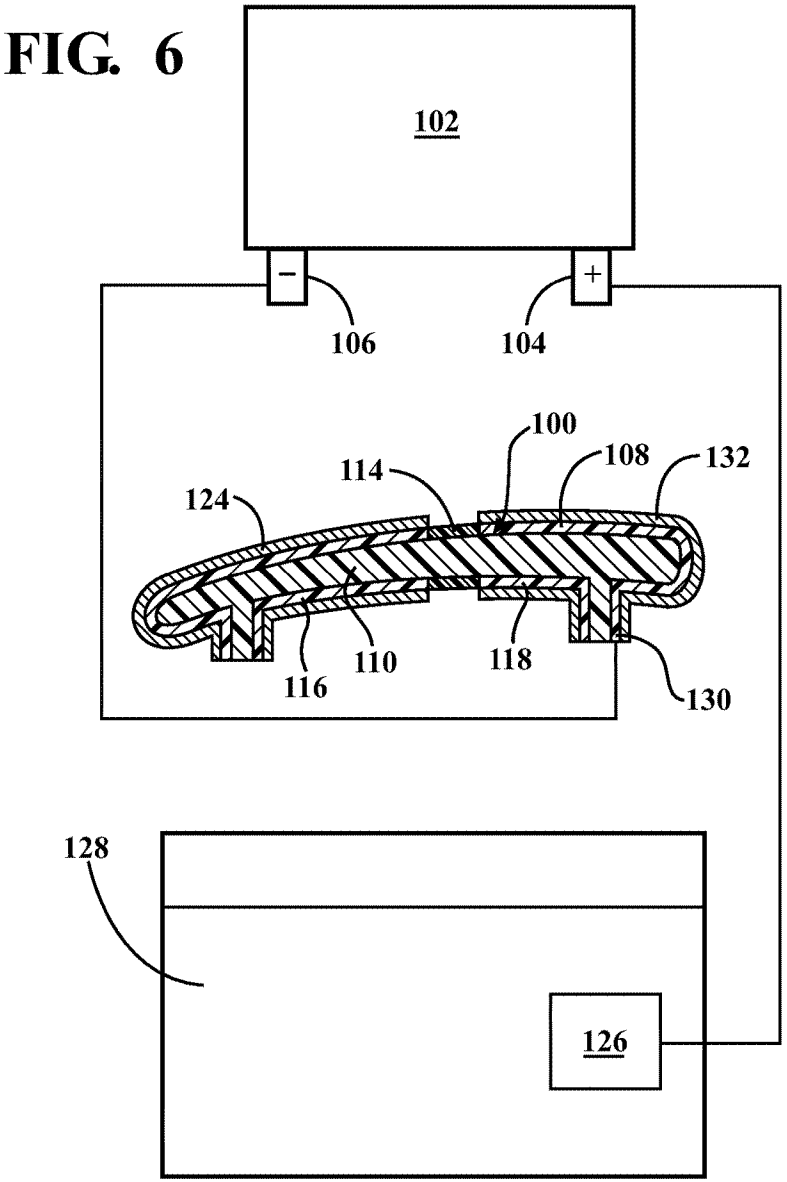
FIG. 6 is a side cross-sectional view of a power source, a second aqueous solution, a second anode and a work piece in accordance with an aspect of the disclosure.

According to another aspect, as shown in FIGS. 1 and 6, the method can then continue with the step of removing the work piece 100 from the first aqueous solution 122 and connecting the positive terminal 104 of the power source 102 to a second anode 126, as generally indicated by reference number 22. Similar to the first anode 120, the second anode 126 may be made of a metal material Also, like the first anode 120, the metal material from which the second anode 126 can be comprised may include, but is not limited to, nickel, zinc, palladium, gold, cobalt, chromium (i.e., chrome), and alloys thereof. It will be appreciated that a variety of other suitable materials may also be employed. According to an aspect, the second anode 126 may be of a different metal than the metal of the first anode 120. Also like the first anode 120, the second anode 126 may be in the form of a solid mass of material that is insoluble or soluble, while the plating solution is composed of a plurality of metal salts necessary to achieve the desired plated layer 128. It will be appreciated that different metal finishes can also be achieved utilizing the same anodes such as for example with a Bright Chrome part and a Satin Chrome part.

According to a further aspect, the method can then proceed with connecting the negative terminal 106 of the power source 102 to a second point of contact 130 on the second segment 118 of the work piece 100, as generally indicated by reference number 24. The work piece 100 may then be immersed in the second aqueous solution 128 which contains the second anode 126, as generally indicated by reference number 25. After the work piece 100 has been immersed in the second aqueous solution 128, the method can continue with positively charging the second anode 126 and negatively charging the second segment 118 of the work piece 100 to cause metal ions from the second plating solution 126 to be passed onto the electroless layer 108 on the second segment 118 of the work piece 100 to form a second electroplated layer 132 on the second segment 118, as generally indicated by reference number 26. It should be appreciated that a metal layer only forms on the second segment 118 of the work piece 100 because the first and second segments 116, 118 are electrically insulated from one another by the barrier 114, 214, 314.

As a result of the aforementioned steps, after the second electroplated layer 132 of metal has been formed on the second segment 118 of the work piece 100, the first and second segments 116, 118 have different metallic finishes. It should further be appreciated that additional barriers 114, 214, 314 in conductivity could be made on the work piece 100 to provide additional segments that are electrically insulated from one another. Such additional segments could be electroplated in accordance with the aforementioned steps to provide for more than two segments of the work piece 100 that have different metallic finishes.

According to a still further aspect, to improve adherence of the first and second electroplated layers 124, 132 to the work piece 100 and to improve the structural properties of the work piece 100, an intermediate electrolytic layer of copper from an acid copper plating solution may be applied to both the first and second segments 116, 118 after the electroless layer of material 108 is applied to the work piece 100, and prior to electroplating the first and second electroplated layers 124, 132 as described above. Applying this intermediate layer can build the metal thickness to a level that is sufficient to carry the current for electroplating of subsequent metal layers. After the intermediate copper layer has been electrodeposited to a sufficient thickness, an intermediate layer of sulfur-free nickel may be electroplated onto the copper surface to protect the copper from corrosion on all electrical pathways on the part. After the deposition of the intermediate layer of sulfur-free nickel is electroplated on the work piece, there can be a significant amount of metal to carry current, and the copper layer is protected. Therefore, the work piece 100 can be immersed in any suitable plating solution and electroplated as described above to provide the first and second electroplated layers 124, 132 to achieve the desired finishing effect. It should be appreciated that the method could alternatively proceed without these steps and other materials could be used in these steps in place of those described. It will additionally be appreciated that intermediate layers consisting of different materials could be applied to the first and second segments 116, 118 to provide different appearances for the work piece 100.

According to a further aspect of the present disclosure, after a barrier 114, 214, 314 is created as described above to electrically isolate multiple sections of a work piece 100, an electrophoretic coating may be selectively deposited on at least one of the sections of the work piece 100 in order to create different aesthetic affects. It will be appreciated that the deposition of the electrophoretic coating may occur in connection with the deposition of one or more different metal layers as discussed above. It will be appreciated that different electrophoretic coatings may be selectively deposited in the same fashion discussed above such that one electrophoretic coating may be applied to one section of a part without it being applied to another section of the part.

According to a still further aspect of the present disclosure, as the barriers can be formed on both the front side 140 and the back side 142 of the work piece 100, metal layers are not deposited thereon, as discussed above. As shown in the Figures, a light source 150, 250, 350 may be disposed behind the work piece 100 and positioned to emit light into the barriers to provide a backlighting effect, as shown, to enhance aesthetics. It will be appreciated that the use of a transparent or translucent material at the barrier can assist with this effect, although non-translucent or non-transparent materials may also be employed. Alternatively, the work piece 100 may be formed of resins of different colors to provide additional aesthetic affects.

Figure 7:
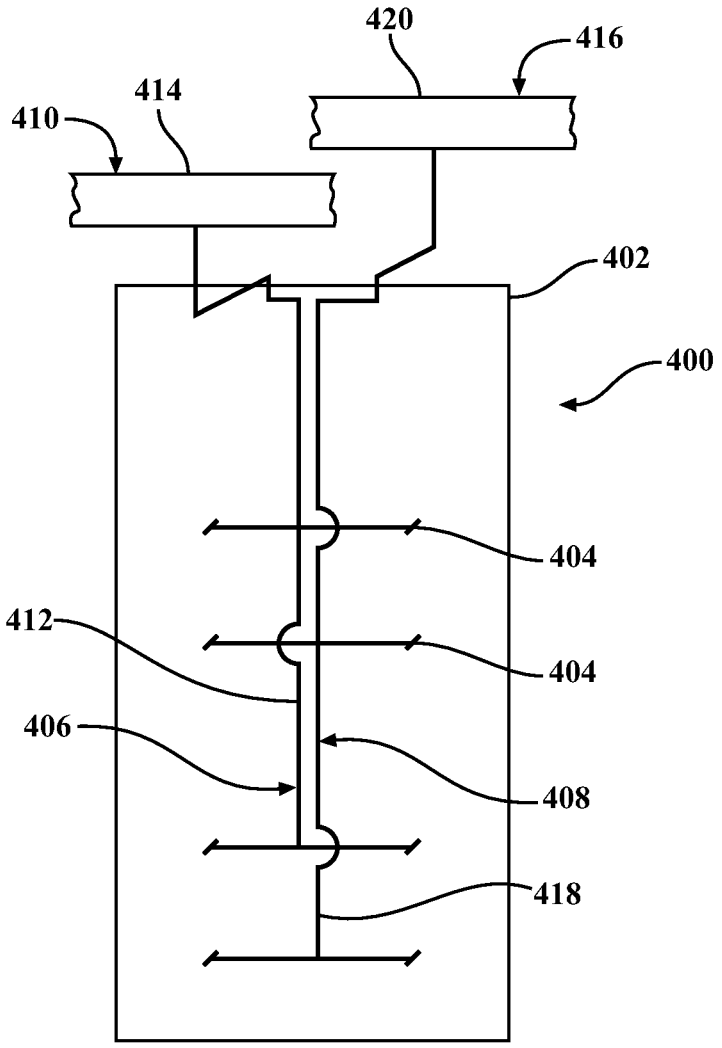
FIG. 7 is a schematic illustration of a plating tool for use in plating a work piece in accordance with an aspect of the disclosure.

FIG. 7 illustrates a plating tool 400 in accordance with an aspect of the disclosure. As shown, the tool 400 can include a plating rack 402 with a plurality of rack tabs 404, which are configured to hold individual work pieces that are to be subjected to a plating process. According to an aspect, the plating tool 400 can include multiple current pathways, which may be referred to as a first circuit 406 and a second circuit 408. Each of the first circuit 406 and the second circuit 408 can be selectively actuated such that each of the circuits can be active at separate times as desired. According to another aspect, the first circuit 406 can be configured such that it is in communication with a first segment 116 of the work pieces 100 located on the rack tabs 404 of the plating rack 402 such that current is applied thereto to effectuate plating a metal layer onto the first segment 116. This allows for first segments of multiple work pieces to be subjected to a plating process simultaneously. According to a further aspect, the second circuit 408 can be configured such that it is in communication with a second segment 118 of the work pieces 100 located on the rack tabs 404 of the plating rack 402 such that current is applied thereto to effectuate plating of a separate metal layer onto the second segment 118. This allows for second segments of multiple work pieces to be subjected to a plating process simultaneously. It will be appreciated to more than two circuits can be integrated into the plating rack 402 to accommodate plating multiple different metal layers onto a surface of the work piece 100.

According to an aspect, the first circuit 406 can include a first power source 410, a first cathode 412 and a first connector bushing 414. The first power source 410 can provide power to the first cathode 412 to charge at least a portion of one or more work pieces. The first power source 410 may be in communication with the first cathode 412 via the first connector bushing 414. According to a further aspect, the first cathode 412 may be integrated into the plating rack 402. According to a still further aspect, the second circuit 408 can include a second power source 416, a second cathode 418, and a second connector bushing 420. The second power source 416 can provide power to the second cathode 418 to charge at least a portion of one or more work pieces. The second power source 416 may be in communication with the second cathode 418 via the second connector bushing 420. The second cathode 418 may also be integrated into the plating rack 402.

According to an aspect, each of the circuits 406, 408 may be electrically insulated from each other. Additionally, each of the circuits 406, 408 can connect to separate power sources such that each of the circuits can be activated individually or simultaneously as desired. The use of separate circuits allows for the plating of different metals on a single work piece. According to a further aspect, the plating rack 402 may be coated with a plate resistant coating to prevent rack plate-up as well as rack damage. The plate resistant coating may be Platisol, however, a variety of other suitable coatings may be employed.

It will also be appreciated that an auxiliary anode may also be incorporated into the tooling to assist in the deposition of metal in areas where the electrical current density is limited, such as recessed areas.

Obviously, many modifications and variations of the present disclosure are possible in light of the above teachings and may be practiced otherwise than as specifically described while within the scope of the appended claims. These antecedent recitations should be interpreted to cover any combination in which the inventive novelty exercises its utility. The use of the word "said" in the apparatus claims refers to an antecedent that is a positive recitation meant to be included in the coverage of the claims whereas the word "the" precedes a word not meant to be included in the coverage of the claims.

What is claimed is:

1. A method of creating an automotive part having multiple decorative surfaces, comprising:

forming a plastic work piece of a first material;

creating at least one barrier in electrical conductivity in the work piece to divide the work piece into multiple segments, wherein the at least one barrier is formed on at least a front side of the work piece and the at least one barrier separates a first segment and a second segment of the work piece, wherein the barrier is formed of a second material that is different from the first segment and the second segment of the work piece;

rendering at least the front side of the work piece segments conductive through an electroless plating process including an electroless layer of material;

wherein the second material of the at least one barrier is a material that substantially prevents the electroless layer of material from being formed thereon;

immersing the workpiece in a plating solution;

after rendering at least the front side of the work piece segments conductive through the electroless plating process, creating a first metal finish on the first segment of the plastic work piece through a plating process, while not applying the first metal finish to the second segment of the work piece during the plating process, wherein the plating process includes applying current via a first circuit that includes the first segment and wherein the first metal finish includes a first plurality of metal layers that are applied to the first segment via the first circuit;

creating a second metal finish on the second segment of the plastic work piece through a plating process, while not applying the second metal finish to the first segment of the work piece, wherein the plating process further includes applying current via a second circuit that includes the second segment and wherein the second metal finish includes a second plurality of metal layers that are applied to the second segment via the second circuit;

wherein the first metal finish and the second metal finish are different whereby the work piece has multiple different external appearances;

wherein the first and second circuits are separate circuits that are defined at the same time, and the currents applied via the first and second circuits are separate currents from separate power sources, wherein the first circuit includes a first cathode and a first power source, and the second circuit includes a second cathode and a second power source, where the first and second cathodes are different and the first and second power sources are different, thereby defining the separate first and second circuits;

wherein the currents applied via the first and second circuits are applied simultaneously to the first and second segments such that at least one of the first plurality of metal layers and at least one of the second plurality of metal layers are deposited on the work piece at the same time;

wherein the first and second segments of the front side of the workpiece have a non-planar curvature.

2. The method of claim 1, wherein the step of rendering at least the front side of the work piece conductive includes forming the plastic work piece of a non-conductive material and applying the electroless layer of material to the work piece using the electroless plating process.

3. The method of claim 2, wherein the step of creating at least one barrier in electrical conductivity includes applying a plating resistant coating on the work piece.

4. The method of claim 3, wherein the plating resistant coating is selected from at least one of the following: a polyvinyl chloride and a polycarbonate.

5. The method of claim 2, wherein the step of creating at least one barrier in electrical conductivity includes molding a non-platable material on the work piece through a molding process.

6. The method of claim 5, wherein the molding process is selected from at least one of the following: a multi-shot injection molding process, a transfer molding process and an over-molding process.

7. The method of claim 1, wherein the step of creating at least one barrier in the work piece includes creating a front side barrier on the front side of the work piece and a back side barrier on a back side of the work piece.

8. The method of claim 7, wherein the front side barrier and the back side barrier are in alignment such they reside in the same plane.

9. The method of claim 1, further comprising:

creating a different visual effect at the at least one barrier than a visual effect provided by each of the first metal finish and the second metal finish.

10. The method of claim 9, wherein the step of creating a different visual effect at the at least one barrier includes employing a light source adjacent the back side of the work piece which is configured to emit light through the at least one barrier.

11. The method of claim 9, wherein the step of creating a different visual effect at the at least one barrier includes forming the work piece of a colored plastic.

12. The method of claim 1, further comprising:

creating a plurality of barriers in at least the front side of the work piece to allow for application of more than two different metal surfaces to the front side.

13. The method of claim 1, further comprising:

depositing an intermediate layer on the work piece before application of the first metal finish.

14. The method of claim 13, wherein the intermediate layer is formed of a copper material.

15. The method of claim 1, wherein the first metal finish and the second metal finish have the same base metal or alloys thereof.

16. The method of claim 15, wherein the first metal finish and the second metal finish are selected from one or more of the following:

nickel, zinc, palladium, gold, cobalt, chromium, or alloys thereof.

17. The method of claim 16, where the first metal finish and the second metal finish have different gloss levels.

18. The method of claim 17, wherein the first metal finish consists of a bright chrome finish and the second metal finish consists of satin chrome finish.

19. The method of claim 16, wherein the first metal finish and the second metal finish have different colors.

20. The method of claim 1, wherein the work piece is one of multiple work pieces having electrically isolated first and second segments, wherein each of the multiple work pieces are held by a plating tool having a plating rack and multiple current pathways, the multiple current pathways including the first circuit and the second circuit, wherein each of the first segments of the multiple work pieces are connected to the first circuit and each of the second segments are connected to the second circuit.

21. The method of claim 1, wherein at least one of the first segment or the second segment is disposed on the front side of the work piece and also on a back side of the work piece.

22. The method of claim 1, wherein the non-planar curvature includes a recessed area, wherein electrical current density is limited in the recessed area, wherein at least one of the first and second circuit includes an auxiliary anode to assist in deposition of metal in the recessed area where the electrical current density is limited.

23. The method of claim 1, wherein the plating tool includes an auxiliary anode incorporated therein, wherein the auxiliary anode assists in metal deposition in recessed areas of the work piece where electrical current density is limited.

24. A method of creating an automotive part having multiple decorative surfaces, comprising:

forming a plastic work piece;

forming at least one barrier in electrical conductivity in the work piece to divide the work piece into at least a first segment and a second segment, wherein the at least one barrier is formed on at least a front side of the work piece, wherein the at least one barrier is formed of a material that substantially prevents an electroless layer of material being formed thereon, wherein the first segment and the second segment define a non-planar curvature;

simultaneously rendering the first segment and the second segment of the work piece conductive by applying an electroless layer of material on the first segment and the second segment;

immersing the work piece in a plating solution;

creating a first metal finish on the first segment of the plastic work piece through a plating process that includes applying current via a first circuit that includes the first segment, wherein the first circuit includes a first cathode and a first power source;

creating a second metal finish on the second segment of the plastic work piece through a plating process that includes applying current via a second circuit that includes the second segment, wherein the second circuit includes a second cathode and a second power source;

wherein the first cathode is separate from the second cathode;

wherein the first power source is separate from the second power source;

wherein the first metal finish is Bright Chrome and the second metal finish is different whereby the work piece has multiple different external appearances;

wherein the first metal finish the second metal finish have the same base metal;

wherein the first and second circuits are separate circuits, wherein the first circuit includes the first segment at the same time that the second circuit includes the second segment;

wherein the currents applied via the first and second circuits are separate isolated currents and are applied simultaneously via the first and second circuits, respectively, to create at least one layer of the first and second metal finish simultaneously;

wherein the work piece is one of multiple work pieces having electrically isolated first and second segments, wherein each of the multiple work pieces are held by a plating tool having a plating rack and multiple current pathways, the multiple current pathways including the first circuit and the second circuit, wherein each of the first segments of the multiple work pieces are connected to the first circuit and each of the second segments are connected to the second circuit;

wherein the multiple work pieces and the plating rack are separate, and each of the multiple work pieces are molded separately and, following each of the work pieces being molded separately, each of the multiple work pieces are attached to the plating rack.

* * * * *